US008376151B2

(12) United States Patent
Breeden et al.

(10) Patent No.: US 8,376,151 B2
(45) Date of Patent: Feb. 19, 2013

(54) MERCHANDISING AND DISPLAYING OF TOWING PRODUCTS

(75) Inventors: Winston Breeden, Chagrin Falls, OH (US); Thaddeus T. Brej, Rocky River, OH (US)

(73) Assignee: Winston Products LLC, Cleveland, OH (US)

( * ) Notice: Subject to any disclaimer, the term of this patent is extended or adjusted under 35 U.S.C. 154(b) by 176 days.

(21) Appl. No.: 12/949,184

(22) Filed: Nov. 18, 2010

(65) Prior Publication Data

US 2011/0114579 A1 May 19, 2011

Related U.S. Application Data

(60) Provisional application No. 61/262,279, filed on Nov. 18, 2009.

(51) Int. Cl.

| | |
|---|---|
| ***A47F 7/00*** | (2006.01) |
| ***A47F 5/00*** | (2006.01) |
| ***A47B 43/00*** | (2006.01) |
| ***A47B 47/00*** | (2006.01) |
| ***A47H 1/00*** | (2006.01) |

(52) U.S. Cl. . 211/59.2; 211/70.6; 211/193; 211/106.01; 211/103

(58) Field of Classification Search ..... 211/59.2, 211/60.1, 70.6, 94.01, 193, 59.1, 57.1, 7, 211/54.1, 52, 55, 10, 106, 106.01, 100, 13.1; 248/241–243, 218.1, 304

See application file for complete search history.

(56) References Cited

U.S. PATENT DOCUMENTS

| | | | | |
|---|---|---|---|---|
| 2,311,932 | A * | 2/1943 | Deckard | 211/70.4 |
| 2,805,777 | A * | 9/1957 | Larson | 211/70.1 |
| 2,937,762 | A * | 5/1960 | Deuter | 211/106.01 |
| 3,388,806 | A * | 6/1968 | Cunningham, Jr. et al. | 211/85.5 |
| 4,109,794 | A * | 8/1978 | Samuel et al. | 211/85.3 |
| 4,289,243 | A * | 9/1981 | Arbuzoff | 211/35 |
| 5,351,839 | A * | 10/1994 | Beeler et al. | 211/59.3 |
| 5,509,541 | A * | 4/1996 | Merl | 211/103 |
| 5,518,127 | A * | 5/1996 | Warmack et al. | 211/193 |
| 5,584,404 | A * | 12/1996 | Tsai | 211/94.01 |
| 5,740,927 | A * | 4/1998 | Yemini | 211/70.6 |
| 5,857,577 | A * | 1/1999 | Thomas et al. | 211/94.01 |
| 6,152,312 | A * | 11/2000 | Nava et al. | 211/94.01 |
| 6,279,761 | B1 * | 8/2001 | Niewiadomski et al. | 211/94.01 |
| 6,382,430 | B1 * | 5/2002 | Dewsnap | 211/59.2 |
| 6,401,941 | B1 * | 6/2002 | Maumus | 211/59.1 |
| 7,086,541 | B2 | 8/2006 | Robertson | |
| 7,147,113 | B2 | 12/2006 | Obstfeld et al. | |
| 7,152,748 | B2 | 12/2006 | Vosbikian | |
| 7,178,681 | B2 * | 2/2007 | Libman | 211/106 |
| 7,426,997 | B2 | 9/2008 | Nagelski | |
| 7,438,268 | B2 | 10/2008 | Kologe | |
| 7,572,249 | B2 | 8/2009 | Betts | |
| 2002/0117464 | A1 * | 8/2002 | Ehrgott | 211/189 |
| 2003/0132179 | A1 * | 7/2003 | Duquette | 211/70.6 |
| 2007/0068887 | A1 * | 3/2007 | Richard Nawrocki | 211/70.6 |
| 2007/0251904 | A1 * | 11/2007 | Winig et al. | 211/106.01 |
| 2008/0067296 | A1 | 3/2008 | Seyler | |
| 2008/0110842 | A1 | 5/2008 | Duchatellier | |
| 2008/0296242 | A1 | 12/2008 | Worden et al. | |
| 2009/0234724 | A1 | 9/2009 | Bates et al. | |
| 2009/0278787 | A1 | 11/2009 | Ott et al. | |
| 2012/0037578 | A1 * | 2/2012 | Weshler et al. | 211/59.3 |

* cited by examiner

*Primary Examiner* — Jennifer E. Novosad

(74) *Attorney, Agent, or Firm* — Cooper Legal Group, LLC

(57) ABSTRACT

A merchandising display for heavy and cumbersome products includes a rail that is supported by a display wall and arms attached to the rail. The arms are spaced from other arms to create columns and rows of retail product stock. The merchandising display further includes structure for providing indicia that assists a viewer to quickly and easily locate desired retail products and other complementary products. Customer accessible back-up inventory is provided behind the first retail product.

14 Claims, 4 Drawing Sheets

MERCHANDISING AND DISPLAYING OF TOWING PRODUCTS

RELATED APPLICATIONS

This application claims the benefit of U.S. Provisional Patent Application No. 61/262,279 filed on Nov. 18, 2009, the entire disclosure of which is hereby incorporated herein by reference.

FIELD OF THE INVENTION

The present application relates to a merchandising display and method of displaying merchandise in accordance therewith. More particularly, the present application relates to displaying towing products for retail sale.

BACKGROUND OF THE INVENTION

Due to their steel construction, the typical components used for towing a trailer (ball mounts, hitch balls, couplers, etc) are very heavy and cumbersome. In a retail setting, this presents a unique problem for the 'point of purchase' displaying and merchandising of these products. Conventionally, major retailers of this category currently merchandise towing products horizontally. It is also common for there to be many variations of each component offered for sale in the retail environment. It is difficult for these variations to be distinguished from one another since they all appear similar to the untrained eye and/or are disorganized. Furthermore, these many variations require a significant amount of the retail space making the efficient use of that space critical.

BRIEF SUMMARY OF THE INVENTION

The following presents a simplified brief description of the invention in order to provide a basic understanding of some example aspects of the invention. This brief description is not an extensive overview of the invention. Moreover, this brief description is not intended to identify critical elements of the invention nor delineate the scope of the invention. The sole purpose of the brief description is to present some concepts of the invention in simplified form as a prelude to the more detailed description that is presented later.

In accordance with one aspect, the invention provides a merchandising display that includes a rail supported by a display wall. There is at least one arm attached to the rail and each arm has a proximal end and a distal end. The arms have a support surface to support a retail product in midair. The arms also have sufficient length to support a first retail product and a retail product stock behind the first retail product. The arms have sufficient strength to withstand supporting heavy retail products hanging in a vertical orientation. Each arm is spaced from other arms to create columns and rows of retail product stock. The merchandising display provides a means of providing indicia that assists a viewer.

In accordance with another aspect, the invention provides a method of displaying retail products. The method includes the step of providing a structure to support a retail product in midair. The method further includes the step of arranging the structure to create at least one column and at least one row for display of the retail product. The method also includes placing a first retail product and a retail product stock on the structure such that the removal of the first retail product enables a viewer to see the retail product stock behind the first retail product. The method still further includes providing indicia to a viewer consisting of at least one member selected from the group consisting of product branding, product category information, and product classification.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
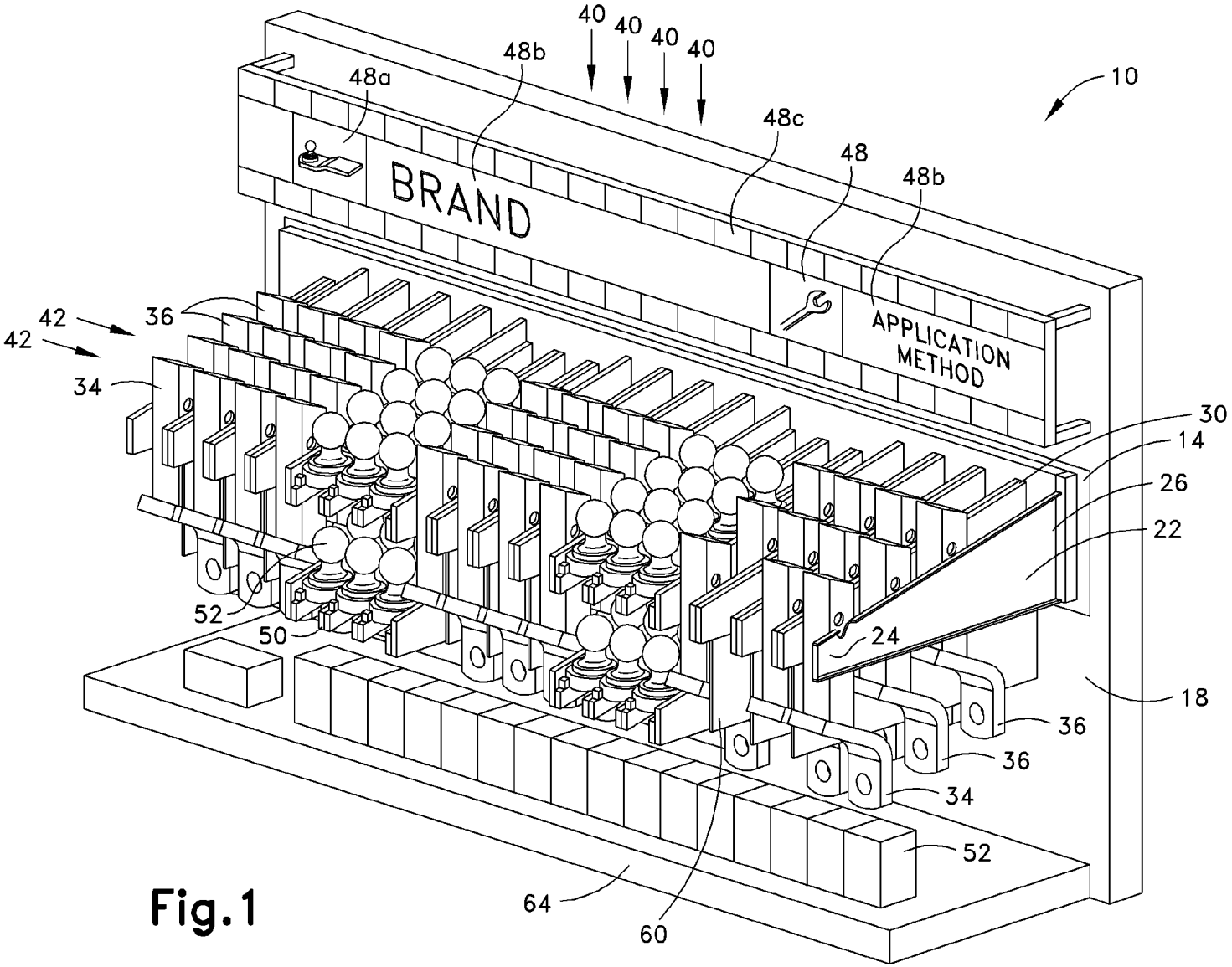
FIG. 1 is an elevation view of an example merchandising display for heavy and cumbersome retail products in accordance with one aspect of the present invention.

The following detailed description illustrates a merchandising display for heavy and cumbersome retail products and a method for using the same. Example embodiments that incorporate one or more aspects of the present invention are described and illustrated in the drawings. These illustrated examples are not intended to be a limitation on the present invention. The disclosure is described herein as being applied to a preferred embodiment, namely, a merchandising display for heavy and cumbersome retail products such as towing products. However, it is contemplated that this disclosure has general application to a broad range of merchandising displays and in a variety of applications other than for heavy and cumbersome retail products. Moreover, certain terminology is used herein for convenience only and is not to be taken as a limitation on the present invention.

Towing products can include various products related to the towing or supporting of auxiliary items behind or in front of a vehicle, including land, sea, or air vehicles. Example towing products can include, but are not limited to, ball mounts, hitch balls, couplers, ball receivers, hitch receivers, hitch pins and locks, hitch covers, electrical couplings, protection gear, installation tools, vehicle tailoring mounts, etc. Also, it is to be appreciated that the towing products may include packaging, wrappings, supports, hangers, individual indicia and the like. It is to be appreciated that many towing products are heavy (e.g., made of metal).

Also, it is to be appreciated that many towing products are bulky, large or similar. In particular, at least one product that has a longitudinal extent, such as the receiver-style ball mount. The receiver-style ball mount has an elongate portion for extending into an opening of a receiver located on a vehicle. In one example, such elongate portion is solid metal and has a generally square cross-section. At least one aperture extends into the elongate portion. This aperture is for alignment with a corresponding aperture(s) in the receiver on the vehicle. A hitch pin extends through the aligned apertures and thus secures the ball-mount relative to the receiver and thus the vehicle (i.e., with the elongate portion within the receiver). The ball mount also has a tongue extending from the elongate portion. The tongue has a flattened portion with an aperture for receiving a threaded mounting shaft of a hitch ball. The hitch ball can be secured onto the tongue via a threaded nut tightened onto the threaded shaft. The entire receiver-style ball mount is generally made of metal and is relatively heavy. Also, overall the receiver-style ball mount is elongate and is fairly long. Thus the receiver-style ball mount has a longitudinal extent. Although not shown, the receiver-style ball mount may include one or two temporary/disposable hang projections (e.g., via a temporary/disposable plastic dowel extending through the aperture of the elongate portion).

At least another product that has a longitudinal extent is a hitch ball. The hitch ball has a spherical upper portion for receipt into a female coupling portion of a trailer. At the base of the spherical portion the hitch ball has a collar. A threaded portion extends downward from the spherical upper portion. As such the hitch ball has a major axis, and thus an elongation, along the extent of the threaded portion and through the spherical portion. Although not shown, the hitch ball may include packaging.

The towing products are intended to include products for consumer sale/use as well as professional sale/use. Generally, the towing products can be displayed on a shelf at a point of sale, such as within a retail store, in such a way that the different towing products within a line-up are visible to a consumer during the consumer's purchasing decision process.

Figure 2:
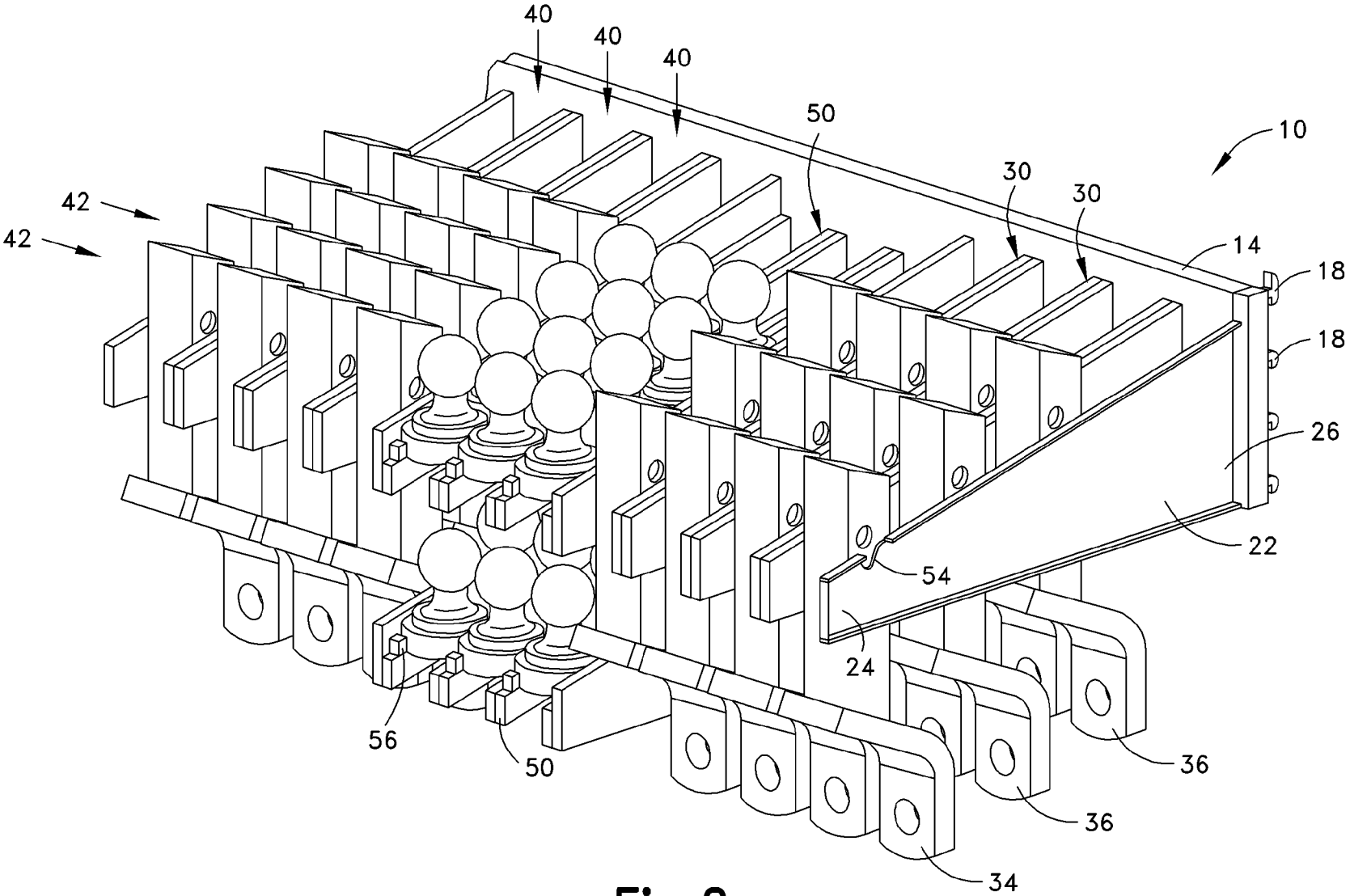
FIG. 2 is a perspective view of selected elements shown in FIG. 1.

Turning to FIG. 1, one example of a merchandising display 10 is presented. The merchandising display 10 includes a rail 14. The rail 14 provides a framework for supporting retail products in midair. The merchandising display 10 can be used to create a user-friendly display for heavy and cumbersome retail products. As such, the rail 14 should be sufficiently strong to firmly support the cantilevered weight of heavy products. The rail 14 is mounted to a display wall 16. It is to be understood that the display wall 16 can be a traditional wall in a retail store, a wall of a pre-fabricated display unit, wire frame structure, or any other generally vertical surface that is able to support a merchandising display. The rail 14 can be mounted to the display wall 16 with the use of standard shelving attachment tabs 18 (as seen in FIG. 2) that lock into slots on the display wall. It is to be understood that the merchandising display 10 and method presented can be used with existing store display walls 16, such as such as pegboards, slat-walls, wire grids, shelving, etc., and/or can be an independent structure. As such, the rail 14 attachment to the display wall 16 can take any standard form of attachment as are typically used with those structures.

A number of arms 22 are mounted to the rail 14. The arms 22 can be an integral part of the rail 14, or the arms can be mounted to the rail in a fixed or detachable manner. The arms 22 extend from the rail 14 in a generally horizontal direction and have a proximal end 24 and a distal end 26. While it is contemplated that the present example can be utilized for many different merchandising display applications, the arms 22 are intended to have sufficient strength to withstand supporting heavy retail product 32, such as towing products. Within the shown example, the shown retail product 32 includes a selection of receiver-style ball mounts and ball hitches. Also, the retail product can include a portion that is otherwise supported (e.g., 52). Herein the reference numeral 32 can be used to refer to all of the retail product (e.g., all of the receiver-style ball mounts and all of the ball hitches of the shown example) or just some (e.g., just the receiver-style ball mounts or just the ball hitches) or an individual retail product (e.g., just one of the receiver-style ball mounts or just the ball hitches). To be clear, for the shown example, the receiver-style ball mount is one example retail product.

Each arm 22 has at least one support surface 30. The support surface 30 can be the top edge of the arm 22 or can be a ledge-like structure along some other portion of the arm, a slot, or any other support surface as is known in the art. The support surface 30 contacts a portion of an individual retail product 32 and supports the retail product in midair (i.e., the retail product is not otherwise resting on a shelf or the like).

One support surface 30 can contact one portion of the retail product 32 to support the retail product in midair. Alternatively, multiple support surfaces 30 can contact multiple portions of the retail product to support the retail product in midair. As an example, FIG. 1 shows consecutive arms 22 with support surfaces 30 contacting opposite sides of a retail product 32 in order to support it in midair. In another example, the support surfaces 30 can contact packaging for the retail product 32 in order to support the retail product in midair. In the case of the receiver-style ball mount the support surface 30 can engage one or two of the temporary/disposable hang projections (e.g., a temporary/disposable plastic dowel extending through the aperture of the elongate portion). Such temporary/disposable hang projections are not show for in the drawings Figures to permit viewing other structures.

With regard to each receiver-style ball mount as the retail product 32, it is to be noted that the elongate portion (i.e., the portion that is to be received within a receiver on a vehicle) is oriented vertically and located adjacent to the arm 22. Moreover, the tongue is located vertically below the elongate portion. A majority of the weight of the receiver-style ball mount is below its support point (i.e., at the aperture (e.g., via temporary/disposable hang projections). Thus, the receiver-style ball mount is hanging in a vertical orientation.

It is to be appreciated that the shown vertical orientation of the receiver-style ball mount is just one example. It is to be appreciated that the receiver-style ball mount may be inverted from the orientation shown within the example in the Figures. The inversion of the receiver-style ball mount would still have a vertical orientation on the elongation. In one example, the tongue of the receiver-style ball mount could be wider than the elongate portion. Such wider tongue thus provides shoulders that could be wider than the spacing between adjacent arms 22. Thus, the shoulders of the tongue of the receiver-style ball mount could rest upon the support surface of at least one arm 30. Still further, a different support element and/or packaging (e.g., different from the temporary/disposable plastic dowel extending through the aperture of the elongate portion) may be provided/utilized. For example, sliding hooks could be utilized. The hooks can slide along the support surface(s) 30. It is even possible to have the hooks be entrapped or captive within the arm 22 to move along the support surface.

The arms 22 and the support surfaces 30 are of sufficient length to support multiple retail products 32 in a linear fashion. FIG. 1 shows a number of arms 22 with support surfaces 30 supporting a first retail product in front of other retail product stock 36 behind the first retail product. As such, the reference number 36 is used to indicate additional product behind a first is a queue along each arm 22. When a viewer, such as a consumer, removes the first retail product 34 from the merchandising display 10, the viewer is able to see a supply of similar products (i.e., 36) that is available in the same column 40 that was behind the first retail product.

The rail 14 and arms 22 can be arranged to create columns 40 and rows 42 of retail products 32. A plurality of columns 40 can be arranged to provide a generally vertical display orientation of retail products 32. The merchandising display 10 can provide a plurality of columns 40 and/or rows 42 that are distinct, adjacent, and spaced apart so as to be separate from each other. Some of the columns 40 can provide individual rows 42 for displaying additional products in generally the same vertical plane. Still other portions of the merchandising display 10 can be arranged to provide a generally horizontal display of retail products 32. The columns 40 and rows 42 can be apportioned according to the size of the retail products 32, according to the preferences of a viewer, or according to other parameters in order to meet the overall goals of the merchandising display 10.

The merchandising display 10 can further include a means of providing indicia that assists a viewer. Various indicia can assist the viewer via organized information such as branding information, product category information, indexing information, and/or product specific information, etc. The levels of information provide navigational directions to the viewer to direct the viewer to the merchandise being displayed that would meet the viewer's needs.

One example of indicia communicating information to the viewer relates to branding of the retail products 32 on display. The brand of the product being displayed is an important piece of the information disclosed to a perspective consumer. The brand initially tells the consumer that they are in the correct location and that the products they are looking at are manufactured by or associated with a known or desired brand. As used herein, the term "brand" refers to any term, symbol, design or combination thereof that identifies and differentiates a seller's product and/or service which typically arise in the minds of consumers. One example brand includes TOWSMART™.

For example, the merchandising display 10 can include indicia placed on a sign 46 toward the top front of the merchandising display. The sign 46 can include visual indicia such as graphics 48*a* that can indicate the type of retail product 32 included in the merchandising display 10. Text 48*b* such as brand indicators or retail product 32 features can also be included on the sign 46 or on other elements of the merchandising display 10 as visual indicia. Bands 48*c* of colors can also be included on the sign 46. The various color sections of the bands 48*c* can align with the columns 40 and correspond with retail product 32 packaging in order to convey information such as product category or a classification within a product category.

Another form of indicia provided by the merchandising display 10 is the column 40 and row 42 arrangement. Each column 40 and row 42 can be designated for a particular aspect of the retail product 32. For example, a group of columns 40 can be dedicated to supporting one product category of retail product 32. The column and row indicia can to the viewer product category information such as ball mounts, hitch balls, couplers, ball receivers, hitch receivers, hitch pins and locks, hitch covers, electrical couplings, protection gear, installation tools, etc. The indicia can lead the viewer to look in one column for various hitch receivers in the retail product 32 line-up.

Similarly, a group of rows 42 can provide retail product 32 classification within each category. Retail product 32 classification can identify and differentiate different versions of similar products within a category according to the product's rated specifications, recommended uses, etc. For example, ball mounts can be identified in various classes, such as Class I, II, III, IV, V, etc. according to rated towing capacity. Similarly, hitch balls can be identified in various sizes, such as 1.5", 1.875", 2", etc., and/or ball receivers can be identified by class, drop or rise height, ball mount specification, etc.

Other visual indicia can be provided on the sign 46 or on the retail product 32 packaging such as colors, symbols, or patterns. Using towing products as an example, the indicia provided to assist the viewer can utilize similar types of text, symbols, color schemes, audio, video, etc. on complementary products to help guide a user's decision. For example, all Class II rated merchandise can be color-coded green, while all Class III rated merchandise can be color-coded blue. Similarly, the shelf 64 locations can be color-coded in a corresponding manner to assist in re-stocking of the merchandising display 10. Furthermore, combinations of indicia can be used to communicate additional quantities of information. For example, colors can be combined with shapes, shading, or other indicia to aid a viewer in making product selections. Thus, the apparatus and method are designed to readily convey information to a viewer, such as a shopping consumer, to more quickly direct the viewer to the appropriate retail products 32, thereby reducing shopping time and increasing the likelihood that the consumer finds the desired retail product 32, and/or complementary product(s), for the specific application(s) for which they were shopping. It is to be appreciated that other indicia can be provided such as audio, video, manufacturer product codes, UPC codes, other machine-readable codes, etc. provided in physical and/or electronic manners as are known in the art.

In another example, the various indicia can provide levels of communication to assist a store clerk in re-stocking the merchandising display in a pre-determined manner, providing a consistent merchandising display 10 over time. In yet another example, the indicia provided to assist the viewer can also be provided as machine-readable code to help guide automated machinery that automatically picks stock or replenishes stock in the merchandising display 10.

Generally, the merchandising display 10 and method include a means to provide indicia to convey information to the viewer to facilitate purchasing decision(s). By providing various indicia described herein, the merchandising display 10 and method can provide a consumer with identification information that can significantly reduce the time required for a consumer to locate a specific product which would meet the consumer's needs over prior art displays. It should be understood that more or less indicia could be used and benefits still be achieved therefrom. It should also be understood that the levels could be provided in different combinations, sequences, styles, etc. and still be within the scope of the described merchandising display 10 and method.

Turning to FIG. 2, in another example, the merchandising display 10 can include arms 22 that further include a non-hanging support surface 50. Similar to the support surface 30, the non-hanging support surface 50 can be the top edge of the arm 22, a ledge-like structure along some other portion of the arm, a slot, or other support surface as is known in the art. The non-hanging support surface 50 contacts a portion of an individual retail product 32 and supports the non-hanging retail product 52 in midair. One non-hanging support surface 50 can contact one portion of the non-hanging retail product 52 to support the retail product in midair. Alternatively, multiple non-hanging support surfaces 50 can contact multiple portions of the non-hanging retail product 52 to support the retail product 32 in midair. As an example, FIG. 2 shows consecutive arms 22 with non-hanging support surfaces 50 contacting opposite sides of a non-hanging retail product 52 in order to support it in midair. In another example, the non-hanging support surfaces 50 can contact packaging for the retail product 32 in order to support the retail product in midair.

Within the shown example, hitch ball are provided as an example as a non-hanging retail product 52 that is supported in mid air. It is to be noted that the majority of the weight of each hitch ball is above its portion of engagement with the arms, with the portion of engagement being the collar of the hitch ball. A threaded portion, and possibly a nut located therein, is located below the portion of engagement. Thus, such product does not hang, but is still supported in midair. Although, there is still vertical orientation of the product.

In yet another example, the merchandising display 10 can include arms 22 having support surfaces 30 angled to provide a lower elevation at the proximal end 24 than other points toward the distal end 26. This angle in the support surfaces 30 is such that the retail product stock 36 in each column 40 are gravity fed toward the proximal end 24 so as to automatically replace any removed retail product 32. It is to be understood that the non-hanging support surfaces 50 can incorporate the same angle to automatically replace any removed non-hanging retail product 52. It is to be further appreciated that although the shown example has an angled support surface 30 on the arm, it is possible to have a different angle or no angle (i.e., level). Such a surface with no angle (i.e., level) would not provide for gravity movement of the retail product stock 36.

In another example, the merchandising display 10 can include a stop or lock structure to prevent accidental release of any retail products 32 from the merchandising display by moving past the proximal end 24 of the arm 22. As seen in FIG. 2, this can include a cut-out section 54 of a support surface 30. The cut-out section 54 is designed to interact with a feature of the retail product 32 or its packaging. As the retail product 32 slides down the angled support surface 30, a portion of the retail product or its packaging will slide into the cut-out section 54 and prevent the retail product from sliding any farther toward the proximal end 24 of the arm 22. In addition or alternatively, an arm 22 can include a raised stop 56. The raised stop interacts with a feature of the retail product 32 or its packaging to prevent the retail product from sliding any farther toward the proximal end 24 of the arm 22. It is to be appreciated that the stop or lock structure can take numerous other forms such as saw-tooth profiles, high-friction surfaces, gates, and any other structures as are known in the art.

In yet another example, the merchandising display 10 can include protection structure 60 to inhibit contact between retail products 32 in adjacent columns 40. The protection structure 60 can be attached to an arm 22 and extend downward. Hanging retail products 32 can sometimes, through collision, damage other retail products that are in close proximity, and the protection structure 60 can eliminate a level of damage. Additionally, the protection structure 60 can help keep the columns 40 of retail products 32 in an orderly line, inhibiting problems in gravity feed or product removal that may arise from retail products 32 in other columns blocking the path of the retail product stock 36.

In another example, the merchandising display 10 can include an arrangement of arms that enables a nested retail product 32 arrangement. Retail products 32 can include designs or shapes that do not easily lend themselves to narrow column 40 display. The merchandising display 10 can provide for a plurality of columns 40 and/or rows 42 that are partially covered by the next proceeding column 40 and/or row 42 in a manner known in the industry as a stair-stepped arrangement. This arrangement can be readily observed in FIG. 2 as columns of ball hitches.

In yet another example, the merchandising display 10 can include a shelf 64 for various non-hanging retail product 52. As best seen in FIG. 1, a shelf 64 is shown to hold various other non-hanging retail products 52, such as hitch pins and locks, etc. It is to be appreciated that indicia to assist the viewer as previously described can continue to the shelf 64, including text, symbols, colors, etc.

In another example, the retail products 32 can be vertically displayed in a non-hanging manner by being maintained vertically within a tray or the like. It is to be understood that any or all of the retail products 32 can be displayed in any manner, and the illustrated examples are not intended to be limiting. Further, any or all aspects of the merchandise display can be formed using various manufacturing techniques, such as wire form, sheet metal stampings, molding operations (i.e., blow molding, injection molding, roto-molding, etc.), combinations thereof, etc. and using various materials, such as metal, plastic, wood, rubber, glass, paper, etc.

Figure 3:
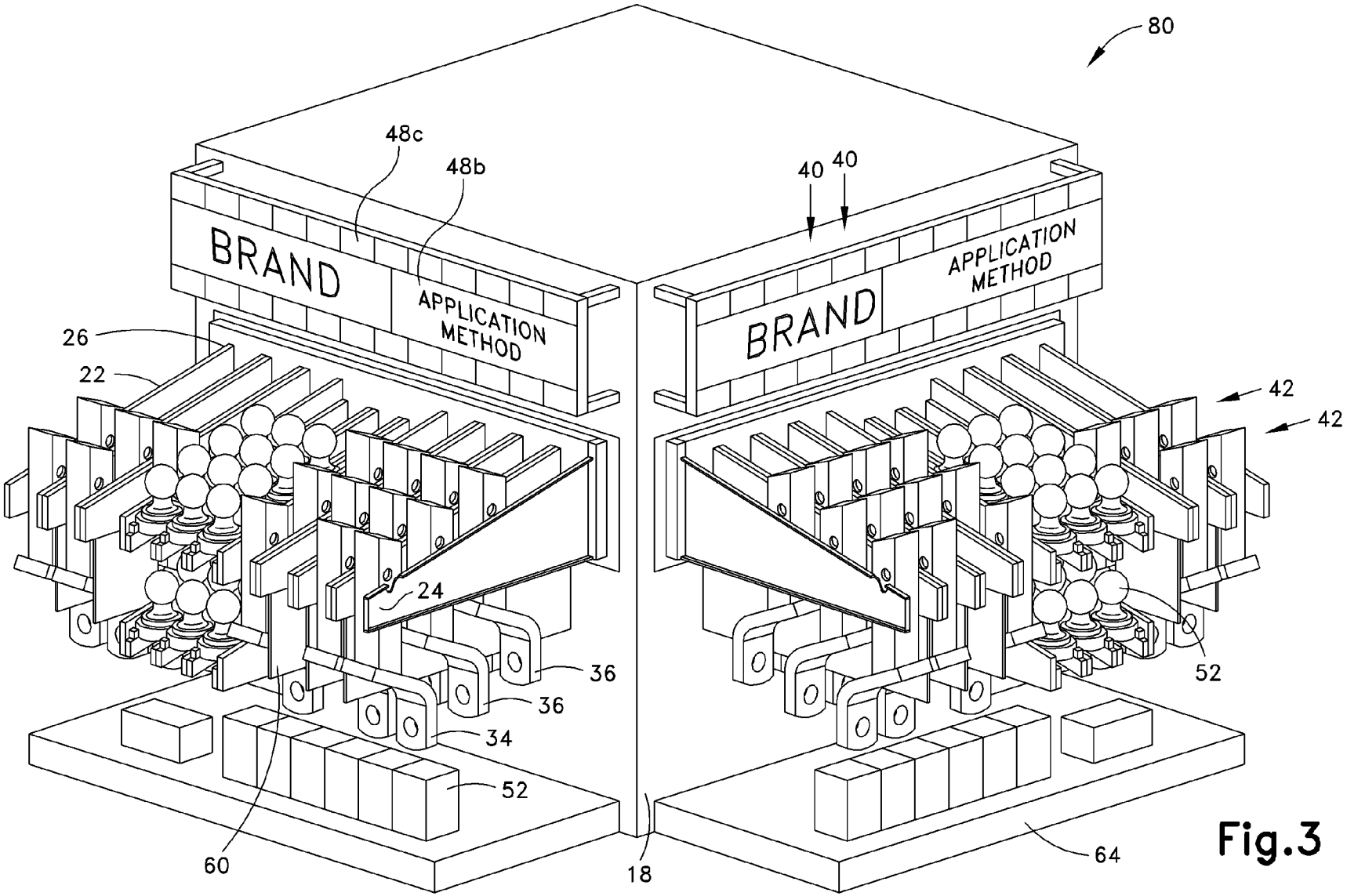
FIG. 3 is a perspective view of another example merchandising display for heavy and cumbersome retail products in accordance with one aspect of the present invention.

Turning to FIG. 3, another example merchandising display 80 is presented. The merchandising display 80 can be its own independent structure, and need not rely upon a separate display wall 16 which can be a part of a retail store wall or some other pre-fabricated display structure. Additionally, the merchandising display 80 can be able to rotate, allowing the viewer to remain in one location while perusing the retail products 32 of the entire merchandising display.

Figure 4:
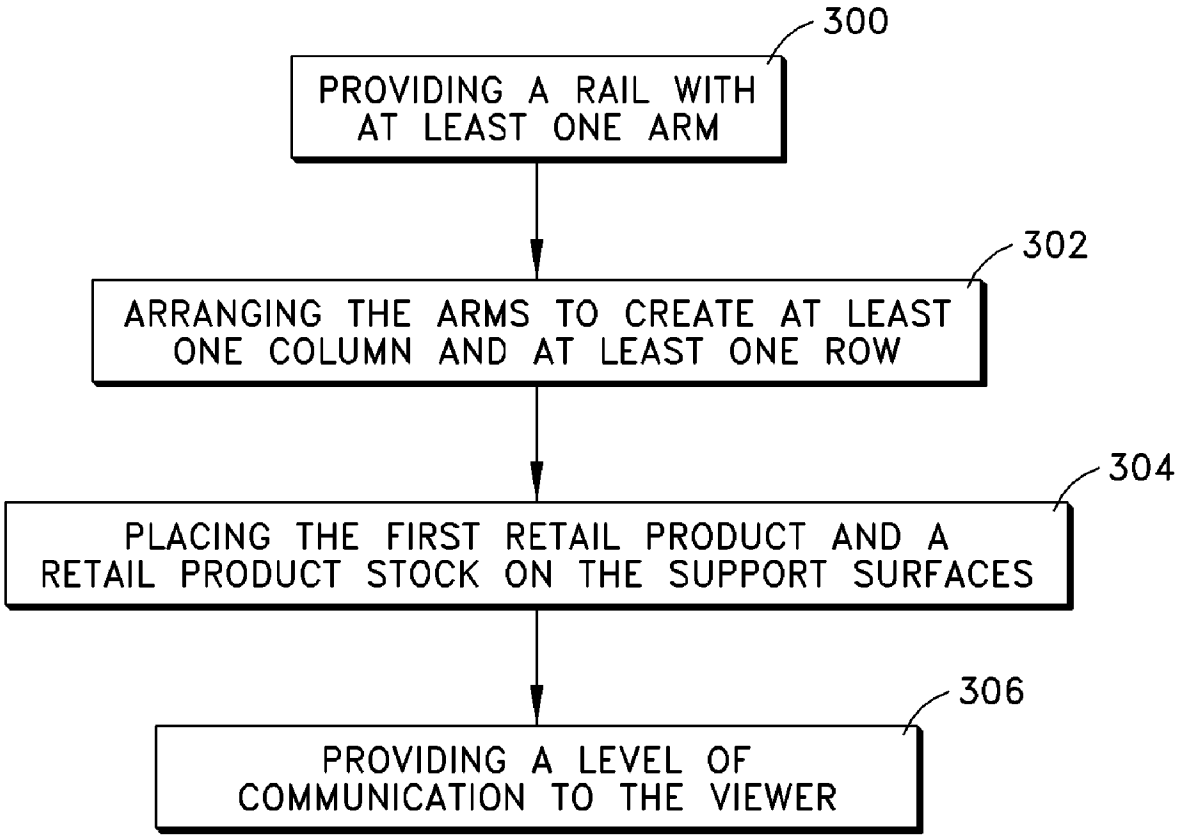
FIG. 4 is a top-level flow chart of a method in accordance with one aspect of the present invention.

Turning to FIG. 4, a method of displaying retail products is described. The method includes the step 300 of providing structure to support a retail product 32 in midair. One example of how to accomplish this step is to provide a rail 14 which is attached to a display wall 16. Arms 22 can be attached to the rail 14, and the arms can include support surfaces 30 to contact a portion of the retail products 32 and support them in midair as described above.

The method further includes the step 302 of arranging the structure to create at least one column 40 and at least one row 42 for display of the retail product 32. This step can be accomplished by arranging the arms 22 in patterns that create columns 40 and rows 42 that are suitable for displaying retail products 32. The arm 22 placement can provide for a plurality of columns 40 and/or rows 42 that have no overlap or are partially covered by the next proceeding column 40 and/or row 42 in a manner known in the industry as a stair-stepped arrangement as described above.

The method further includes the step 304 of placing a first retail product 34 and a retail product stock 36 on the structure such that the removal of the first retail product enables a viewer to see the retail product stock behind the first retail product. One way to accomplish this step is to place the retail products 32 on the support surfaces 30 of the arms 22 such that retail product stock 36 is behind the first retail product 34 from the aspect of the viewer. In this way, when the first retail product 34 is removed from the support surface 30, the merchandising display 10 appears to be well stocked. As described above, the support surfaces 30 can be generally parallel to the ground and/or can be angled such that the retail product stock 36 in each column 40 are gravity fed toward the proximal end 24 so as to automatically replace any removed retail product 32.

The method further includes the step 306 of providing indicia to a viewer to assist in retail product 32 selection of at least one member selected from the group consisting of product branding, product category information, and product classification. One way to accomplish this step is to provide signs coupled to or separate from the merchandising display, directly on the products offered for sale, pamphlets, etc.

The method can further include indicia provided by communication of at least one of the following: text, symbols, color schemes/coding, audio, video, etc. provided in physical and/or electronic manners as described above.

The merchandising display 10 and method can provide for various advantages over the prior art. One advantage is a presentation of retail products 32 to a potential customer in an intuitive and easy to handle manner.

It is another advantage of the described merchandising display 10 and method is the provision of customer-accessible back-up inventory.

It is another advantage of the described merchandising display 10 and method is the provision of a merchandise rack display system which allows product merchandise to be fully displayed in an attractive and organized manner.

It is another advantage of the described merchandising display 10 and method is the provision of a merchandise rack display system which has the versatility to display a variety of different merchandise effectively and efficiently, using economy of space.

It is still another advantage of the described merchandising display 10 and method is the provision of a merchandise rack display system which can display a great variety of merchandise of different sizes, shapes, and in a multitude of different product containers, in numerous display configurations.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

The following is claimed:

1. A merchandising display with a displayed multitude of towing products as merchandise, the merchandising display including:

a plurality of receiver-style ball mounts being a first displayed merchandise, each ball mount including an elongated portion and a longitudinal extent, the elongated portion including an aperture for a temporary item extending through the aperture, each ball mount including a tongue;

a plurality of hitch balls being a second displayed merchandise, each hitch ball including a collar and a threaded portion;

a rail for fastened support to a display wall; and a plurality of arms attached to the rail and supporting the pluralities of displayed merchandise, each arm having a proximal end and a distal end, the arms having sufficient strength to withstand supporting the displayed merchandise, the arms having support surfaces to support the displayed merchandise in midair, the arms having sufficient lengths to support a front displayed merchandise item and at least a following displayed merchandise behind the first displayed merchandise, for the receiver-style ball mounts as the first displayed merchandise nesting the following displayed merchandise into the front displayed merchandise at the respective tongues, the arms being spaced from other arms to create columns and rows of retail product stock, some of the arms engaging and supporting the collar of the hitch balls, some of the arms for engaging the temporary items extending through the apertures of the ball mounts.

2. The merchandising display of claim 1 wherein at least one of the arms further includes a non-hanging support surface for a non-hanging retail product.

3. The merchandising display of claim 1 wherein at least some of the support surfaces of the arms are angled to provide a lower elevation at the proximal end than other points toward the distal end, providing a gravity feed to bring at least some of the displayed merchandise toward the proximal end of the arm while retaining nesting of the receiver-style ball mounts.

4. The merchandising display of claim 1 further including stop devices upon at least some of the arms to prevent at least some of the displayed merchandise from sliding past a respective proximal end of the respective arms.

5. The merchandising display of claim 1 further including protection structure to inhibit contact between adjacent retail products.

6. The merchandising display of claim 1 wherein the nesting of the ball mount includes nesting of adjacent tongues of adjacent ball mounts.

7. The merchandising display of claim 1 further including a shelf structure for non-hanging displayed merchandise.

8. A method of displaying a multitude of towing products as merchandise, the method including the steps of:

providing a plurality of receiver-style ball mounts as a first displayed merchandise, each ball mount including an elongated portion and a longitudinal extent, the elongated portion including an aperture for a temporary item extending through the aperture, each ball mount including a tongue;

providing a plurality of hitch balls as a second displayed merchandise, each hitch ball including a collar and a threaded portion;

providing a rail for fastened support to a display wall; and providing a plurality of arms attached to the rail and supporting the pluralities of displayed merchandise, each arm having a proximal end and a distal end, the arms having sufficient strength to withstand supporting the displayed merchandise, the arms having support surfaces to support the displayed merchandise in midair, the arms having sufficient lengths to support a front displayed merchandise item and at least a following displayed merchandise behind the first displayed merchandise, for the receiver-style ball mounts as the first displayed merchandise nesting the following displayed merchandise into the front displayed merchandise at the respective tongues, the arms being spaced from other arms to create columns and rows of retail product stock, some of the arms engaging and supporting the collar of the hitch balls, some of the arms for engaging the temporary items extending through the apertures of the ball mounts.

9. The method of claim 8 wherein the step of providing a plurality of arms is further limited such that at least one of the arms further includes a non-hanging support surface for a non-hanging retail product.

10. The method of claim 8 wherein the step of providing a plurality of arms is further limited such that at least some of the support surfaces of the arms are angled to provide a lower elevation at the proximal end than other points toward the distal end, providing a gravity feed to bring at least some of the displayed merchandise toward the proximal end of the arm while retaining nesting of the receiver-style ball mounts.

11. The method of claim 8 further including the step of providing stop devices upon at least some of the arms to prevent at least some of the displayed merchandise from sliding past a respective proximal end of the respective arms.

12. The method of claim 8 further including the step of providing protection structure to inhibit contact between adjacent retail products.

13. The method of claim 8 wherein the step of providing a plurality of arms is further limited such that the nesting of the ball mount includes nesting of adjacent tongues of adjacent ball mounts.

14. The method of claim 8 further including the step of providing a shelf structure for non-hanging displayed merchandise.

* * * * *